US006894238B2

(12) United States Patent
Kralik

(10) Patent No.: US 6,894,238 B2
(45) Date of Patent: May 17, 2005

(54) CONTACTOR WITH STRAND-FREE, SINGLE-INTERRUPTING CURRENT ROUTING

(75) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 209 days.

(21) Appl. No.: 10/216,884

(22) Filed: Aug. 13, 2002

(65) Prior Publication Data

US 2003/0036300 A1 Feb. 20, 2003

(30) Foreign Application Priority Data

Aug. 14, 2001 (DE) ..... 201 13 410 U

(51) Int. Cl.[7] ..... H01H 50/54

(52) U.S. Cl. ..... 200/244; 200/290; 335/106; 335/132

(58) Field of Search ..... 200/250, 244, 200/557, 290; 335/132, 106, 128

(56) References Cited

U.S. PATENT DOCUMENTS

| | | | | | |
|---|---|---|---|---|---|
| 936,724 | A | * | 10/1909 | Ihider | 335/132 |
| 1,082,310 | A | * | 12/1913 | Erickson | 335/132 |
| 1,850,703 | A | * | 3/1932 | Angold | 200/250 |
| 3,731,030 | A | * | 5/1973 | Holzer | 200/290 |
| 4,004,260 | A | | 1/1977 | Happach | |
| 4,103,132 | A | * | 7/1978 | Schwarzkopf | 200/250 |
| 4,344,055 | A | * | 8/1982 | Toda et al. | 335/128 |
| 5,617,067 | A | * | 4/1997 | Arora et al. | 335/132 |

FOREIGN PATENT DOCUMENTS

| | | |
|---|---|---|
| DE | 657730 | 2/1938 |
| DE | 115 537 | 10/1963 |
| DE | 37 43 244 A1 | 6/1989 |
| FR | 1405231 | 5/1965 |
| FR | 2 164 486 | 8/1973 |

* cited by examiner

*Primary Examiner*—Renee Luebke
(74) *Attorney, Agent, or Firm*—Finnegan, Henderson, Farabow, Garrett & Dunner, L.L.P.

(57) ABSTRACT

A contractor (1) having at least two spaced-apart fixed contacts (2, 3) and an at least sectionwise electrically conductive, movable contact bridge (9) having at least two contact points (8) which are associated with the fixed contacts (2, 3). The contact bridge is adapted to be moved to a switched position by a switching force (B) and to a rest position by an opening force (V). The opening force (V) is produced by a pretensioning device (13). A particularly advantageous distribution of the opening force to the two contact points and a reliable switching operation is achieved in that one contact (2) is arranged between the other contact (3) and a point where the opening force (V) acts on the contact bridge (9).

15 Claims, 2 Drawing Sheets

CONTACTOR WITH STRAND-FREE, SINGLE-INTERRUPTING CURRENT ROUTING

BACKGROUND OF THE INVENTION

The present invention relates to a contactor of the type normally used for interconnecting two contacts, which are connected to lines, in an electrically conductive manner, or for disconnecting said contacts from one another in response to a switching signal.

If there is no switching signal, the contactor is in a position of rest in which, depending on the type of the contactor, the two contacts are, in a closed position, either conductively interconnected or, in an open position, disconnected from one another. If the switching signal is applied to the contactor, said contactor will move from the rest position to the switched position, e.g. from the closed position to the open position.

Especially for switching high currents, it is known to use contactors with flexible strands. Such strands are, however, expensive, they require space and their service life is not sufficiently long.

It is therefore the object of the present invention to provide a contactor which can be manufactured at a reasonable price and which has a long service life and small structural dimensions.

SUMMARY OF THE INVENTION

In accordance with the present invention this object is achieved by a contactor comprising at least two spaced-apart fixed contacts and an at least sectionwise electrically conductive, movable contact bridge having at least two contact points which are associated with said fixed contacts, said contact bridge being adapted to be moved to a switched position by a switching force which is produced by an actuating means and to a rest position by a pretensioning force which is produced by a pretensioning means and which substantially counteracts the switching force, one contact being arranged between the other contact and a point where the pretensioning force acts on the contact bridge.

This solution is simple and cost efficient. The contact arrangement according to the present invention permits a strand-free configuration and has the effect that less space is required and that the mechanical stability as well as the service life are increased. For conductively connecting the contacts, the contactor according to the present invention is provided with a movable contact bridge having contact points which are associated with the fixed contacts and through which the conductive connection between the contacts is established in the closed position. For this purpose, the contact bridge is electrically conductive, at least as far as the portion of the contact bridge between the contact points is concerned. In the closed position, current flows from one contact via the contact point associated with said contact, the contact bridge and the other contact point to the contact associated with the other contact point.

In order to cause the switching movement of the contact bridge from the rest position to the switched position, an actuating means activated by the switching signal is provided in the contactor according to the present invention. When the actuating means is activated, a switching force is produced by means of which the contact bridge is moved to the switched position.

In order to move the contact bridge from the switched position to the rest position in the deactivated state of the actuating means, a pretensioning means is provided, which produces a pretensioning force that is opposed to the switching force.

Due to the fact that the force application point is located beyond the two contact points, a particularly advantageous distribution of the pretensioning force to the two contact points is obtained, which results in a reliable switching operation.

Special advantages will be obtained, when, in accordance with a further embodiment, the contactor is implemented as a single-interrupting contactor where, in the open position of the contact bridge, at least one contact point is pressed onto the associated contact by the pretensioning force. The contactor of this embodiment is provided with a contact point, which is permanently connected to the associated contact, and with a switching contact on the contact bridge. In the case of this embodiment, it is only the switching contact which is switched by the switching force so as to interconnect the two contacts in an electrically conductive manner.

Since, in this embodiment, only a single contact has to be switched, the switching force can be reduced in comparison with double-interrupting contactors. This leads to smaller dimensions of the actuating means. In addition, when a single-interrupting contactor is used, an arc will occur only at one contact, viz. the switching contact, and the contact resistance during the switching operation will therefore be lower than in the case of double-interrupting contactors. When high currents are switched or when a plurality of switching operations is carried out, the reduced contact resistance will have the effect that the contactor will not heat up as much.

In accordance with a further advantageous embodiment, the contact bridge may form a bearing point, the contact bridge being supported such that it is pivotable about said bearing point from the rest position to the switched position. The pivotable support of the contact bridge permits a compact structural design.

In accordance with an advantageous further development of the present invention, the bearing point can be formed by one of the contacts and a contact point which is associated with said contact. In the case of this embodiment, one contact is permanently closed and serves as a bearing, whereas the other contact represents a switching contact through which the switching operation is realized. The pivoting switching movement of the contact bridge is achieved by the origins of the switching force and of the pretensioning force which, relative to the bearing, are located in opposed relationship with one another.

By means of the opening force at the switching contact, the contact bridge is moved away from the contact to the open position; the contact at the bearing point is simultaneously pressed onto the contact point. The switching force applied by the actuating means counteracts the opening force and produces a torque about the bearing point which is opposed to the torque of the opening force. In the case of this arrangement, high pressure forces can be achieved at the contact points, when the directions of both the switching force and the pretensioning force correspond to each other during the switching operation. At the contact points, these two forces will then add up.

In accordance with a further development, the pretensioning means can be implemented as a spring, e.g. as a helical spring subjected to tension or pressure in the open position, or as a spiral spring or a leaf spring.

In order to realize a switching operation which is as smooth as possible, it will be advantageous when, in accordance with a further development, the actuating means includes an armature plate which is connected to the contact bridge by spring means and through which the switching force is transferred to the contact bridge. The resilient connection between the armature plate and the contact bridge leads to a well-defined switching force which can be adjusted e.g. via the spring preloads or spring constants of the pretensioning means and of the actuating means. The resilient connection between the armature plate and the contact bridge can especially be established via at least one leaf spring.

A compact structural design is possible when the contact bridge is substantially composed of two legs which extend at an angle relative to one another, the origin of the pretensioning force being arranged at one end of a leg. The contact bridge may especially be configured like a lever and have an L-shaped configuration. When the contact bridge is implemented such that it comprises two legs which extend at an angle relative to one another, the closing force required for switching can be reduced by lever action through an advantageous distribution of the contact points and of the points of origin of the opening force, without influencing the physical size of the contactor.

For some applications, it will be advantageous when the switching operation of the contactor is monitored or when additional switching operations take place synchronously to the switching operation of the contactor. This is desirable especially in cases in which high currents are switched via the contactor so as to supply power to electric consumers consuming high amounts of electric power; these high currents can otherwise only be monitored with expensive measurement technology and safety technology.

In accordance with a further advantageous embodiment, such contactors are so conceived that the actuating means is connected to an additional switch, which is coupled in a synchronously switchable manner to the movement of the contact bridge. For this purpose, a further development can be so conceived that the armature plate is provided with an actuating portion co-operating with the additional switch so as to operate the same.

In accordance with a further development, which also permits a compact structural design, a leg of the contact bridge extends substantially parallel to the armature plate.

The contactor according to the present invention can, in particular, be provided with an actuating means producing a closing force which is based on a magnetic field.

In the following, the invention is explained exemplarily on the basis of two embodiments.

DETAILED DESCRIPTION OF THE INVENTION

A structural design of the first embodiment according to FIG. 1 will be described first.

Figure 1:
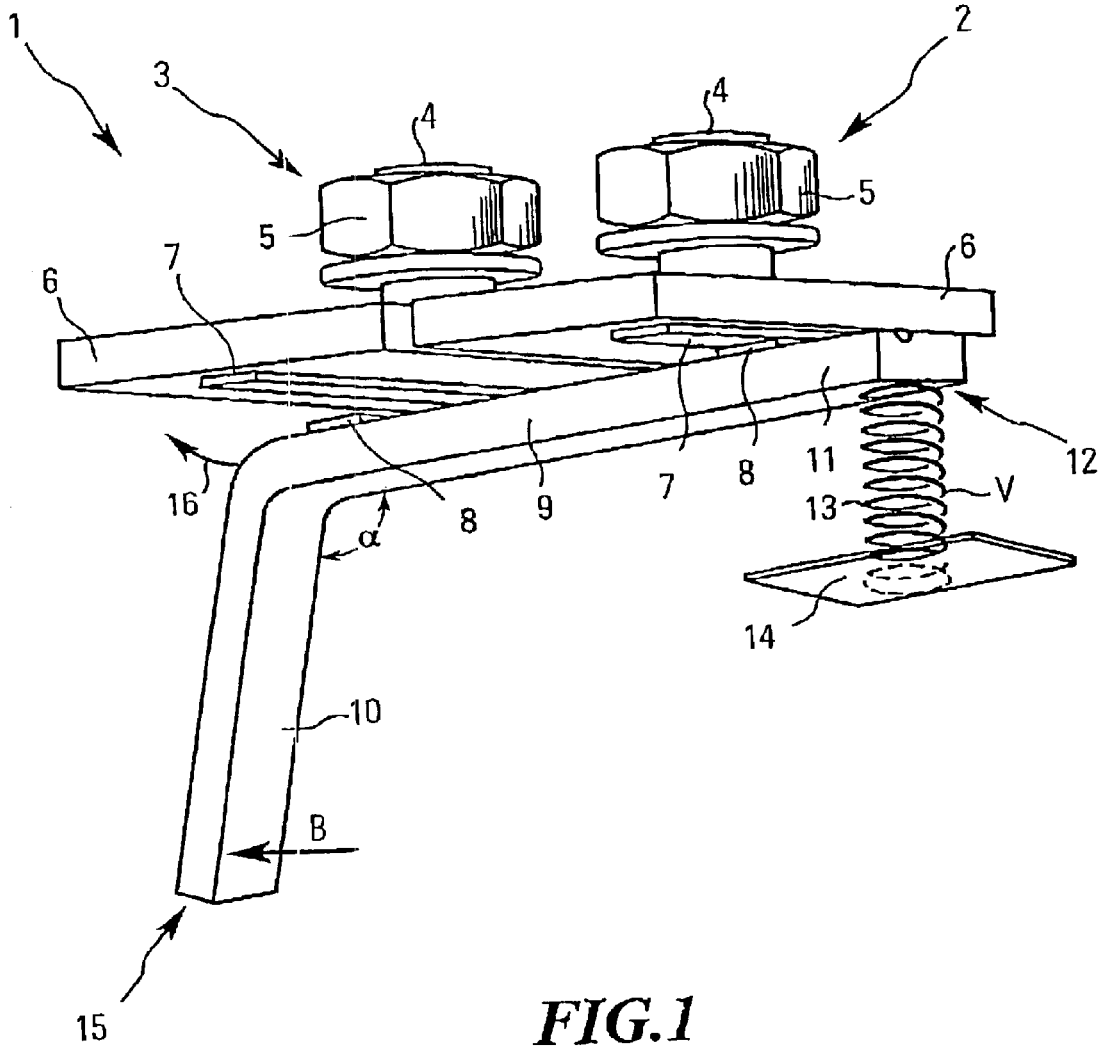
FIG. 1 shows a perspective view of a first embodiment of a contactor according to the present invention and FIG. 2 shows a perspective view of a second embodiment of a contactor according to the present invention.

FIG. 1 shows a contactor 1 comprising a first contact 2 and a second contact 3 arranged in spaced-apart relationship with said first contact. Each of the two contacts 2, 3 has a connecting piece or terminal 4 with a connecting screw 5, said terminals being adapted to have connected thereto wires (not shown) of electric cables (not shown) in an electrically conductive manner. The terminals of the two contacts 2, 3 are connected via conductive plates 6 to contact platelets 7 provided on the lower surface of said conductive plates. The contact platelets 7 are arranged in opposed relationship with respective contact points 8, which, like the contact platelets, are produced from an electrically conductive material. Each contact platelet 7 of a fixed contact 2 and 3, respectively, has associated therewith a contact point 8.

The contact points 8 are arranged on a contact bridge 9 and are interconnected in an electrically conductive manner via said contact bridge 9, which completely consists of an electrically conductive material in the present embodiment. In an alternative embodiment, it may also only be the portion of the contact bridge 9 between the two contact points 8 that is produced from an electrically conductive material.

The contact bridge 9 is implemented in the form of a lever and has two legs 10, 11, which are arranged at an angle $\alpha$ relative to one another. Thus, the contact bridge 9 is substantially L-shaped.

In an end portion 12 of one leg 11 of the contact bridge 9 a pretensioning means 13 is arranged. In the embodiment of FIG. 1, the pretensioning means 13 is implemented in the form of a helical compression spring supported between a housing section 14, which is only schematically indicated in FIG. 1, and the contact bridge 9. The pretensioning means 13 produces a pretensioning force V in the end portion of one leg 11 of the contact bridge 9, said pretensioning force V moving the contact bridge 9 to the open position shown in FIG. 1. In the open position, the two contacts 2, 3 are not interconnected in an electrically conductive manner by the contact bridge 9.

The contactor according to the present invention may also comprise more than two contacts 2, 3 which can be switched independently of one another or synchronously to each other by one or by a plurality of contact bridges 9. This makes it necessary to assign the contact platelets of the contacts in a suitable manner to the contact points of the respective contact bridge. This embodiment of the contactor can be used for carrying out more complex switching operations with a plurality of contacts.

In the contactor 1 shown in FIG. 1, the rest position corresponds to the open position, i.e. the pretensioning force corresponds to an opening force, the switched position corresponds to the closed position, and the switching force corresponds to a closing force.

The switching or closing force B acts on the end portion 15 of the other leg 10 of the contact bridge 9. The effective direction of the closing force B is opposed to the effective direction of the opening force V so that the closing force B causes a movement of the contact bridge in the direction of arrow 16 to the closed position. In the closed position, the contact points 8 of the contact bridge 9 abut in an electrically conductive manner on the contact platelets 7 of the contacts 2, 3 so that an electrically conductive connection between the fixed contacts 2, 3 exists via the contact bridge and the contact points. The ratio of the closing force B to the opening force V must be dimensioned such that the contact bridge 9 can be moved to the closed position against the effect produced by the opening force V. If no closing force B is generated, the contact bridge will return to the rest position in response to the effect produced by the opening force V.

The closing force B is generated by an actuating means which is not shown in FIG. 1 for the sake of simplicity.

In the embodiment of FIG. 1, a contactor is shown in which the rest position corresponds to the open position. By means of simple structural measures, the contactor of FIG. 1 can, however, be converted into a contactor whose rest position corresponds to the closed position, said contactor being moved to the open position by the switching operation. By means of this kinematic reversal, all the advantages of the simply interrupting, strand-free contactor 1 are preserved. For this variant, the compression spring is arranged such that it develops a torque about the bearing point, said torque moving the contact bridge to the closed position. An additional bearing point for supporting the contact bridge (not shown) may be necessary for this purpose.

In the following, the mode of operation of the contactor according to the present invention will be explained on the basis of the embodiment of FIG. 1.

In the rest position, which is shown in FIG. 1, the end 15 of leg 10 is not acted upon by any closing force B. In the embodiment according to FIG. 1, the pretensioning means 13 permanently produces the opening force V, which acts on the end 12 of the leg 11 of the contact bridge 9 and thus presses the contact point 8 against the contact platelet 7 of the fixed contact 2. Thereby, a bearing point is formed at this contact about which the contact bridge 9 is pivotably supported. The pretensioning force V acting as a pressure force leads to a reliable and permanent electrically conductive connection between the contact bridge 9 and the contact 2. The switching operation in the contactor takes place exclusively at the other contact 3, which serves as a switching contact.

Due to the position of its origin relative to the contact points, the pretensioning force V generates a torque about the bearing point which moves the contact bridge 9 to its rest position; in FIG. 1, said rest position being the open position. In the open position, the other contact point 8 is pivoted away from the contact platelet 7 of the fixed contact 3, i.e. the switching contact, on the side of the leg 11 facing the end portion 12, and the electric connection between the fixed contacts 2, 3 via the contact bridge 9 is interrupted. Due to the pivotal movement generated by the opening force V about the contact 2, the switching operation is achieved by opening and closing only one contact. Thus, the formation of an arc is reduced to the switching contact, the transition resistance of the contactor is reduced and the contactor does not heat up as much.

If, in the rest position, a switching force B is applied in the direction of the arrow of FIG. 1, this switching force B produces a torque, which is opposed to the effect of the pretensioning force, about the contact point of the fixed contact 2, said contact point being configured as a support.

In the embodiment according to FIG. 1, this means that the contact bridge 9 moves from the open position to the closed position when the switching force is present: if the closing force B exceeds a predetermined value, the torque about the pivot point of the contact bridge originating from the closing force will become higher than the torque originating from the opening force V and the contact bridge 9 will move to the closing position until the contact point 8 will finally abut against the contact platelet 7 and establish the electrically conductive connection between the two fixed contacts 2, 3.

If the closing force B is eliminated, e.g. if the contactor 1 has no longer applied thereto a switching signal, the contact bridge 9 will return to its rest position, which is shown in FIG. 1.

In the following, the structural design of a second embodiment will be described referring to FIG. 2. The reference numerals used in FIG. 2 for components which are already known from the embodiment according to FIG. 1, as far as their function and their structural design is concerned, correspond to the reference numerals of FIG. 1. Also in FIG. 2, a contactor is shown in which the rest position corresponds to the open position.

Figure 2:
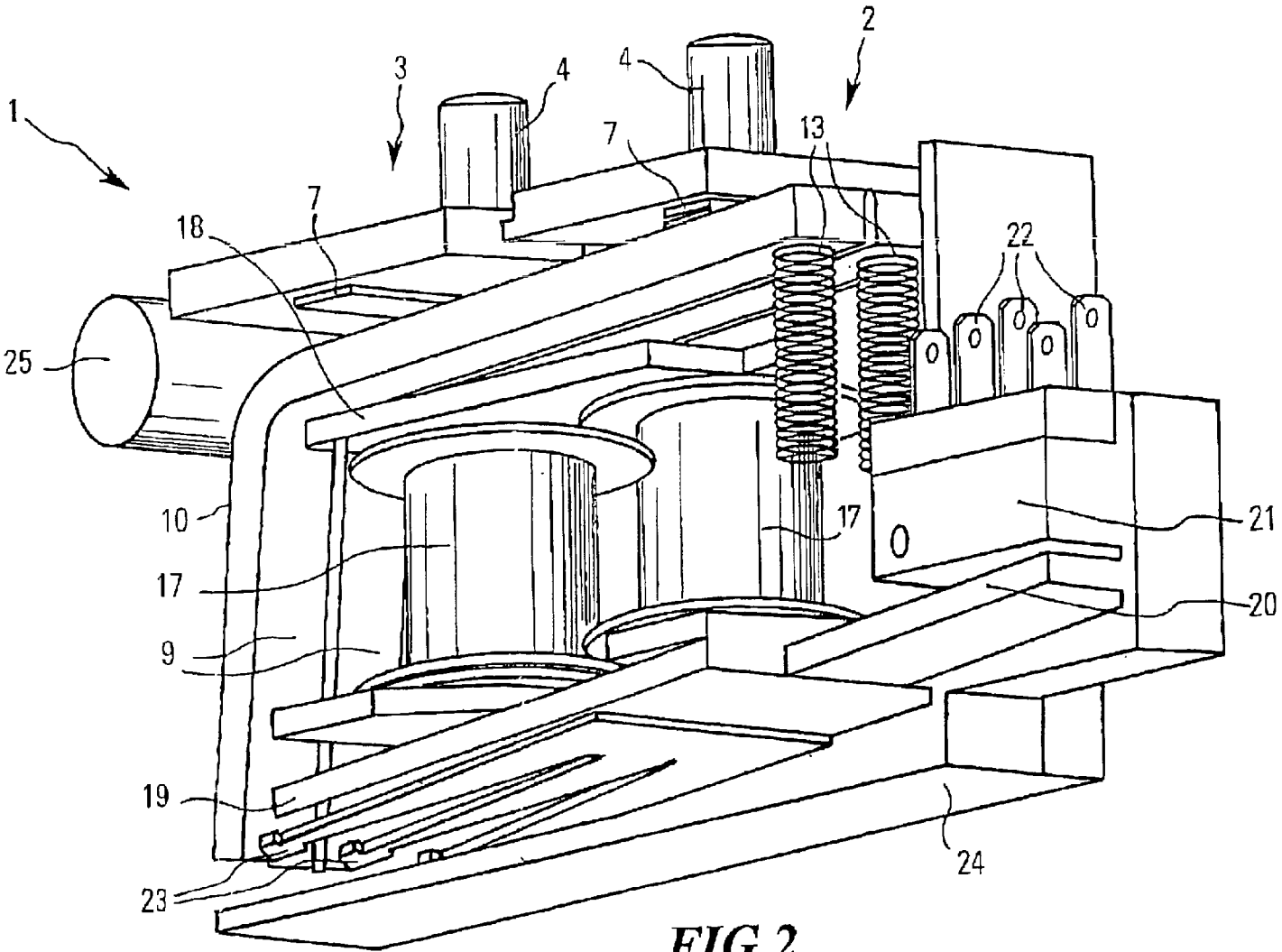

In FIG. 2, a plurality of contact bridges 9 is installed in parallel and switched in parallel. Each contact bridge 9 has associated therewith a pretensioning means in the form of a compression spring 13. The design of the contact bridges 9 and of the contacts 2, 3 in FIG. 2 corresponds to the design of the contact bridge 9 and of the contacts 2, 3 of the embodiment of FIG. 1.

Furthermore, an actuating means for producing a switching force is shown in FIG. 2. The actuating means comprises two coils 17 which represent part of a magnetic circuit having a fixed yoke plate 18 on one side thereof and a movable, in particular pivotable armature plate 19 on the other side thereof. The coils 17 are connected (not shown) to an electric circuit via which the switching signal is applied to said coils, whereupon said coils produce a magnetic field. The magnetic field acts on the armature plate 19 and draws it towards the coils. In this manner, the armature plate 19 carries out a switching movement.

The armature plate 19 is provided with an actuating portion 20 co-operating with an additional switch 21. The additional switch 21 is provided with contact connections 22 which, in turn, are connected to an electric circuit that is not shown.

The armature plate 19 is connected via spring elements 23 to the respective contact bridges 9, the spring elements shown in FIG. 2 being leaf springs 23. Each contact bridge 9 of the contactor 1 of FIG. 2 has associated therewith a leaf spring. On the side facing the armature plate 19, all the leaf springs are integrally connected so as to form a spring plate.

The design of the contactor 1 according to the second embodiment shown in FIG. 2 permits a particularly compact set-up within a small housing 24 containing the pretensioning means, the actuating means as well as the contact bridges. The actuating means 17, 18, 19, 23 is surrounded by the L-shaped contact bridge. The contact bridge and the armature plate 19 form three sides of an articulated parallelogram which accommodates the coils. Thus, the space available is utilized very well. The conductive plates 6 may also be configured such that they constitute part of the housing.

The additional switch 21 permits monitoring of the switching operation of the contactor 1 without any major design costs. Especially if high currents or high voltages are to be switched via the contacts 2, 3, monitoring of the current flowing directly through the contact bridge 9 would be very complicated and expensive in view of the necessary insulations. The switching operation can therefore be monitored at a reasonable price via the synchronous actuation of the additional switch 21. The switches used as additional switches 21 may e.g. be commercially available microswitches.

Finally, a blow magnet 25 or an arc deflector may be provided in the vicinity of the switching contact 3.

The mode of operation of the embodiment according to FIG. 2 corresponds to the mode of operation of the embodiment according to FIG. 1. Only the direction of the closing force extends in the longitudinal direction of the leg 10, i.e. perpendicular to the direction of the closing force B in FIG. 1, due to the leaf springs 23 which act on the end faces of the ends of the legs 10.

Due to the leaf springs 23, excessively strong forces at the switching contact will be avoided even in the case of strong actuating forces and strong magnetic forces, respectively, drawing the armature plate 19 towards the coils 17. In addition, the leaf springs 23 serve as synchronization means by which the switching movement of the armature plate can be transmitted to all contact bridges simultaneously.

Due to the parallel arrangement of a plurality of contact bridges 9, a high operational reliability will be guaranteed, since, for performing a successful switching operation, it will be sufficient when at least one contact bridge 9 interconnects the two contacts 2, 3 in a conductive manner. When the armature plate 19 is drawn towards the coils 17 in response to activation of said coils, the additional switch 21 will be actuated simultaneously by the actuating portion 20 of the armature plate 19.

The contactor shown in FIG. 2 can especially be used for switching high currents, e.g. between 400 A and 600 A, and also currents which are higher than that.

What is claimed is:

1. A contactor comprising at least two spaced-apart fixed contacts and an at least sectionwise electrically conductive, movable contact bridge having at least two contact points which are associated with said fixed contacts, said contact bridge being adapted to be moved to a switched position by a switching force which is generated by an actuating means and to a rest position by an opening force which is generated by a pretensioning means the switching force substantially counteracting the opening force, one contact being arranged between the other contact and a point where the opening force acts on the contact bridge, wherein the contact bridge is substantially composed of two legs which extend at an angle ($\alpha$) relative to one another, and wherein the opening force acts on one end of one of the legs of the contact bridge and the switching force acts on the other of said two legs of the contact bridge.

2. The contactor according to claim 1, wherein, in the rest position of the contact bridge, in which the contacts are electrically separated, at least one contact point is connected to the associated contact by the opening force.

3. The contactor according to claim 1 or 2, wherein the contact bridge has a bearing point, said contact bridge being supported such that it is pivotable about said bearing point from the rest position to the switched position.

4. The contactor according to claim 3, wherein the bearing point is defined by one of the contacts and by a contact point associated with said contact.

5. The contactor according to claim 1, wherein the pretensioning means is implemented as a spring.

6. The contactor according to claim 1, wherein the actuating means includes an armature plate which is resiliently connected to the contact bridge and through which the switching force is transferred to the contact bridge.

7. The contactor according to claim 6, wherein the contact bridge is connected to the armature plate through at least one leaf spring.

8. The contactor according to claim 6, wherein the leg of the contact bridge on which the opening force acts extends substantially parallel to the armature plate.

9. The contactor according to claim 1, wherein the actuating means is connected to an additional switch, which, via a connection means, is coupled in a synchronously switchable manner to the movement of the contact bridge.

10. The contactor according to claim 9, wherein the connection means is formed on an armature plate.

11. The contactor according to claim 1, wherein, in the switched position, the at least two contacts are interconnected in an electrically conductive manner via the contact bridge and the contact points, whereas in the rest position they are disconnected from one another.

12. The contactor according to claim 1, wherein a plurality of contact bridges is arranged in said contactor, each of said contact bridges having at least two contact points.

13. The contactor according to claim 12, wherein a synchronization means is provided by which the plurality of contact bridges are substantially synchronously switchably coupled to each other.

14. The contactor according to claim 12 or 13, wherein each contact bridge has associated therewith a separate pretensioning means.

15. The contactor according to one of the claim 12 or 13, wherein each contact bridge has associated therewith a spring element.

* * * * *